US006817705B1

(12) United States Patent
Crockett et al.

(10) Patent No.: US 6,817,705 B1
(45) Date of Patent: Nov. 16, 2004

(54) INKJET PRINTING DEVICE FOR INKS CONTAINING A HIGH LOADING OF PIGMENT AND INKJET PRINTING PROCESS UTILIZING SAID DEVICE

(75) Inventors: Dennis Crockett, Eye (GB); Alan L. Hudd, Nuthampstead (GB); Christopher M. Evans, Great Chesterford (GB)

(73) Assignee: KBA-Giori S.A., Lausanne (CH)

( * ) Notice: Subject to any disclaimer, the term of this patent is extended or adjusted under 35 U.S.C. 154(b) by 0 days.

(21) Appl. No.: 10/070,582

(22) PCT Filed: Sep. 8, 2000

(86) PCT No.: PCT/CH00/00483

§ 371 (c)(1),
(2), (4) Date: Mar. 8, 2002

(87) PCT Pub. No.: WO01/17783

PCT Pub. Date: Mar. 15, 2001

(30) Foreign Application Priority Data

Sep. 9, 1999 (EP) ..... 99810809

(51) Int. Cl.[7] ..... B41J 2/175

(52) U.S. Cl. ..... 347/85; 347/86; 347/87; 347/88; 347/89

(58) Field of Search ..... 347/85, 86, 87, 347/89, 92, 93

(56) References Cited

U.S. PATENT DOCUMENTS

| | | | | |
|---|---|---|---|---|
| 4,891,654 A | | 1/1990 | Hoisington et al. | |
| 5,341,162 A | * | 8/1994 | Hermanson | 347/92 |
| 5,444,472 A | * | 8/1995 | Due et al. | 347/85 |
| 5,943,078 A | * | 8/1999 | Nishimoto et al. | 347/89 |
| 5,963,236 A | * | 10/1999 | Miyashita et al. | 347/85 |
| 6,478,415 B2 | * | 11/2002 | Barinaga et al. | 347/85 |

FOREIGN PATENT DOCUMENTS

| | | |
|---|---|---|
| EP | 0642924 A | 3/1995 |
| EP | 0736388 A | 10/1996 |
| JP | 60110458 A | 6/1985 |

* cited by examiner

*Primary Examiner*—Ly T Tran
(74) *Attorney, Agent, or Firm*—Woodard, Emhardt, Moriarty, McNett & Henry LLP

(57) ABSTRACT

A continuous inkjet printer is described, which comprises a combination of dispersion agitation means, heated ink supply and printhead and tailored, heated, filtration regime. The use of this combination allows the printing of inks containing a non-magnetic pigment that exhibits "soft settling" upon standing.

10 Claims, 1 Drawing Sheet

Figure 1:
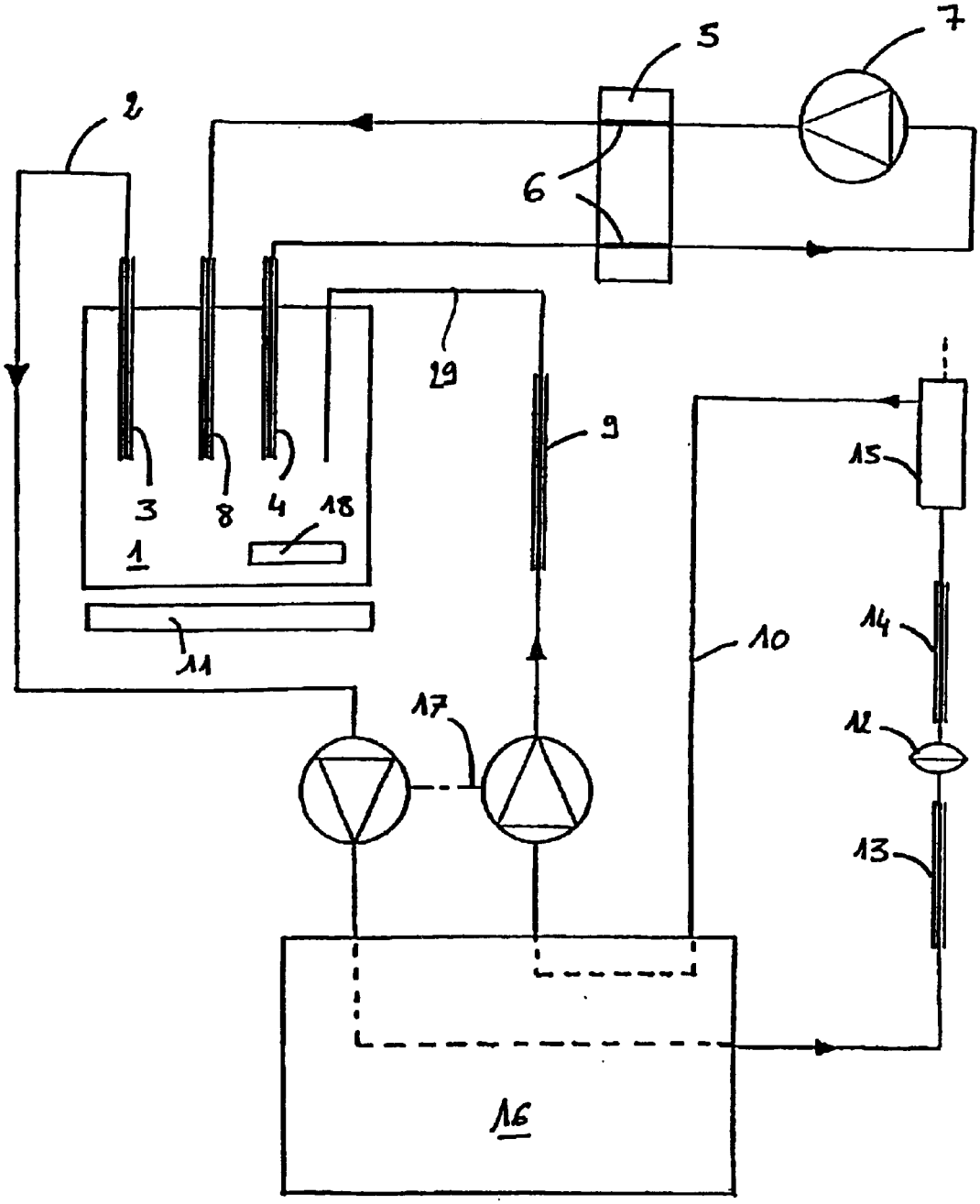

INKJET PRINTING DEVICE FOR INKS CONTAINING A HIGH LOADING OF PIGMENT AND INKJET PRINTING PROCESS UTILIZING SAID DEVICE

This invention relates to an inkjet printing device for inks containing a high loading of pigment, comprising an ink-jet printhead for continuous printing, an ink reservoir, and a feeding circuit for feeding said printhead with ink from the reservoir and returning gutter ink from the printhead to the reservoir. The invention also relates to an inkjet printing process for inks having a high content in high density pigment.

There is an increasing interest in the printing of pigmented inks. However it is well known that when inks contain high density pigments the high density make them difficult to incorporate into inkjet inks. The Brownian motion of the particles in dilute solution is not sufficient to overcome gravitational forces and the particles tend to settle out of the ink and agglomerate. The continuous inkjet printing industry has battled against this problem for over ten years. It is still widely believed within this industry that in order for a pigmented ink to be successfully applied using ink-jet the dispersion must be stable. This requirement places very stringent demands on the ink chemistry, more particularly when inks containing a high loading of pigment or having formulations with room temperature viscosities in excess of 12 cPs or inks that contain security features such as fluorescent pigments have to be applied with continuous inkjet printing technology.

It is an object of the present invention to propose a solution to this problem.

Experiments made by the Applicant with this end in view, have shown that through the utilisation of the device according to the present invention an ink which has only a certain minimum degree of dispersion stability and which exhibits a phenomenon termed "soft settling" can be successfully run and printed in a single nozzle continuous inkjet printer A dispersion which exhibits soft settling is one in which the pigment settles out of dispersion on standing, but is readily redispersed by the application of mild agitation or shaking. A hard settling dispersion is one that cannot be readily redispersed after standing for a period of time.

The present invention therefore relates to an inkjet printing device for inks containing a high loading of pigment, comprising an inkjet printhead for continuous printing, an ink reservoir, and a feeding circuit for feeding said printhead with ink from the reservoir and returning gutter ink from the printhead to the reservoir, wherein the device further comprises on the one hand a two stages mixing arrangement comprising a recirculation loop with mixing means, taking ink from the reservoir and returning it to the reservoir, and a stirring system for ink contained in the reservoir, and, additionally, a means of heating the ink and ensuring the temperature of the ink is maintained at a predetermined temperature, above the ambient level.

According to a preferred embodiment, at least five static mixers are incorporated at strategic points within the system and the printhead feeding circuit comprises a filter placed between two static mixers, upstream of the printhead, and filter heating means arranged in such a manner that the ink temperature in the filter is higher than elsewhere in the printhead supply line. Further, a recirculation loop comprises a recirculation pump located between two static mixers.

According to a second aspect, the invention relates to a process for inkjet printing with inks formed of a dispersion of particles in a liquid.

An embodiment of the device as well as an example of the process will be described hereinafter with reference to the drawing.

FIG. 1 is a schematic view showing a printing device incorporating the features of the invention.

Referring to the drawing, reference 1 designates an ink reservoir. The shape of this reservoir should preferably be a such that efficient stirring of the ink is facilitated. It should not contain any "dead" volume. A cylindrical shape with a rounded bottom edge has been shown to be satisfactory. Also a hemispherical shape of the reservoir would be satisfactory. One experimental implementation of this concept has utilised a 500 ml circular jar with a screw-on lid as a reservoir.

Ink is picked up in the reservoir through a feed line 2 and passes through a first static mixer 3. A static mixer is a well known apparatus which consists of a series of left and right hand helical elements located within a straight tube part. Several companies manufacture mixers of this type. Those manufactured by TAH Industries Inc., of New Jersey USA as well as those manufactured by Statiflo International Ltd., of Cheshire UK have been found to be useful.

Ink pick up line 2 feeds a pump assembly 17 and an ink supply and management system 16.

References 4 to 8 designate an ink recirculation loop which constitutes an important part of the schema. Ink is taken out of the tank 1 through a second static mixer 4, is passed through a stainless steel tube 6, then through a recirculation pump 7 which is preferably a peristaltic pump, then through a further stainless steel tube 6 and returned to the reservoir 1 through a third static mixer 8. Both stainless steel tubes 6 are parallely sunk within the same aluminium block 5 provided with heating means, allowing the stainless steel tubes 6 to be maintained at a constant temperature. The flow rate through the recirculation loop is maintained at a rate several times faster than the flow of ink through the printing side of the system.

Tank 1 finally comprises the return line 29 coming out of the ink management system 16 and going through a fourth static mixer 9. Said fourth mixer 9 is however optional. Acceptable results have been obtained without the same.

Tank 1 is positioned on top of a magnetic stirrer 11 and contains a magnetic stirrer bead 18. Thus two independent agitation means are provided: the recirculation loop 4–8 and the additional stirrer 11 and 18. The latter could also be a rotating mechanic stirrer.

The ink management block 16 includes the pump assembly 17, here symbolised through a pair of separate suction and driving pumps. However this representation is provided as an example only. The ink management block further includes a number of connection and valve and control means which are not represented in detail and which ensure control of the pressure and the composition of the ink: ink supply, solvent supply, measurement of viscosity, flow rate control, etc., as well as feeding of wash liquid. This system may include ink make up reservoir, solvent reservoir, etc.

A further line feeds ink from the management block 16 to the printhead 15. It comprises fifth and sixth static mixers 13 and 14 respectively and a filter 12 provided between the static mixers 13 and 14. Filter 12 is provided with heating means. At the outlet of mixer 14 the ink enters printhead 15 which is a single nozzle heated printhead. The gutter of printhead 15 is returned to ink management block 16 through line 10 and from there to the ink reservoir 1 through static mixer 9.

The operating conditions of the device described will now be discussed.

As has been stated above, the object of the device is to permit a continuous inkjet printer to function with inks containing difficult to disperse pigments. Increasing the viscosity of an ink increases the dispersion stability by decreasing the ease with which the pigment can settle out. However the continuous inkjet printers presently known are designed to work with inks of viscosities between 2.5 and 10 cPs, preferably between 2.8 and 4 cPs. It has been shown, however, that with the device described herein, ink formulations with room temperature viscosities in excess of 12 cPs can be printed. This makes possible the use of inks with higher pigment loadings or increased polymer stabilisation.

The heated ink delivery system as described above is an important feature. Thus for instance tests have shown that despite setting the printhead temperature at 50 degrees C. a temperature of approx. 35 degrees C. was the maximum that could be obtained. When the temperature of the ink supply was raised to 45–50 degrees C. e.g. through passage of the ink in the loop 4–8, the desired head temperature could be achieved. Therefore both the heated printhead and heated ink delivery system are necessary.

Certain aqueous base inks give rise to condensation on the charge electrode when used with a printer as described herein, especially when operating with an elevated printhead temperature. The formation of this condensation, which eventually causes the printer to cease working, can be prevented by the application of a slight positive pressure of air to the charge electrode or, preferably, through the application of low level heat.

Two different mixing technologies comprising a) mixing of the bulk ink in the tank through magnetic or other rotating stirring means and b) constant recirculation in a loop with static mixers, have been found to be necessary and to allow soft settling dispersions to be applied. Soft settling dispersions can be made with difficult to disperse pigments or additional materials intended to add further functionality to the ink.

The use of the described device not only maintains a homogeneous dispersion when the printer is working, but also allows an efficient redispersion of pigment after the printer has been shut down for a period of time (e.g. overnight) When restarting the machine it is only necessary to start the mixing systems in sequence, and then run for a short period of time prior to commencing printing. This redispersion process is aided by utilising a reservoir shape that does not contain any "dead" volume, as described above.

The association, as near as possible from one another, of a heated filter with static mixers located immediately before and after the filter, and of a heated printhead is a key component of the invention.

A heated filtration regime achieves excellent flow characteristics. The purity of flow through a filter is improved and less pressure is required to achieve an acceptable flow rate. Using high pressure with high viscosity would be detrimental to the maintenance of the filter. In addition, by heating the ink the viscosity is reduced which improves the filtration properties of the ink.

Reducing the viscosity increases the rate of pigment settlement, which is undesirable. Therefore to heat the ink to a higher temperature in the region of the filter than elsewhere in the ink supply line improves the filtration properties whilst minimising the settling rate elsewhere in the printer.

Finally a static mixer to the inlet of the filter prevents blockage or loading caused by heterogeneous flow of ink. A static mixer on the exit of the filter ensures that the ink leaving the filter is homogeneous. This is especially important just prior to the nozzle as ink homogeneity is a key requirement for reliable drop formation and jetting.

Tests.

Tests made with a printing device as described have shown the following results:

1. Ink with a viscosity of 5.6 cPs was printed under ambient conditions. The ink recirculation system was unheated. The recorded temperature of both the printhead and the ink was 27 degrees C. The pump pressure and the modulation voltage were set at 2900 mbar and 400 V respectively. The print quality was good.

2. Ink with a viscosity of 12.5 cPs was then printed with the inkjet printer operating in the same conditions as above. (Printhead and ink temperature at 27 degrees C.). Printing was not possible.

3. The same ink as for test No. 2 was then printed with raising the ink temperature to 44 degrees C. and running the printhead at 35 degrees C. The pump pressure and modulation voltage were set at 2815 mbar and 600 V respectively. A satisfactory print could be obtained. The charge electrode was maintained at a temperature of approximately 60 degrees C. during this experiment by heating with a 10 W radiant heat source to prevent the formation of condensation as described above.

This ink was observed to settle out within 1 hour of standing when the magnetic stirrer and recirculation loop were turned off, the ink temperature being maintained at 25 degrees C.

4. Ink with viscosity of approx. 13 cPs was placed in the ink reservoir and then mixed using the magnetic stirrer and the recirculation loop 4–8 as described. Samples of ink were removed from the reservoir at intervals and their viscosity measured:

| Time (min) | 0 | 30 | 60 | 90 | 120 |
|---|---|---|---|---|---|
| Viscosity (cPs) | 13.3 | 13.9 | 13.7 | 13.6 | 13.4 |

Thus a stable dispersion is maintained when both mixing techniques are used. The viscosity was measured at 30 rpm.

5. After mixing for a period of 2 hours, the recirculation loop and the magnetic stirrer were turned off and the ink lest to stand with no agitation.

Within approximately 10 min of the cessation of stirring one could observe visually a significant outsettling.

| Time after cessation of stirring | 30 min | 15 hours |
|---|---|---|
| Measured viscosity (cPs) | 11.3 | 11.4 |

Thus when no additional agitation is used, the dispersion readily settles out.

Maintenance process.

In addition to the different operating steps described above, the following maintenance process can be employed to further improve the reliability of this system.

The system should have a separate flush system containing clean filtered wash fluid. This will be in addition to the replenishment fluid.

Upon shutdown, ink is drained from the head and pipes, and returned to the internal ink container. Flush solution is then pumped throughout the system to rigorously remove the ink. Throughout the sleep mode the printer is left sealed, a containing clean filtered wash fluid.

During the start up sequence, the ink within the ink container will be vigorously stirred, the wash fluid is pumped from the system and ink is introduced with a pulsed pressure regime.

Maintenance during operation will involve periodic flushing of ink throughout the system to ensure no settlement occurs. This will be achieved by briefly pulsing the system with ink between print jobs.

Air management will be important, e.g. by operating under negative pressure or degasing.

What is claimed is:

1. Inkjet printing device for inks containing a high loading of pigment, comprising an inkjet printhead for continuous printing, an ink reservoir, and a feeding line for feeding said printhead with ink from the reservoir and returning gutter ink from the printhead to the reservoir, wherein the device further comprises a two-stages mixing arrangement comprising a recirculation loop with mixing means, said recirculation loop being separate from the feeding line and taking ink from the reservoir and returning it in the same reservoir again, while continuously mixing the ink through a recirculation, and a stirring system for ink contained in the reservoir, and, additionally, a means of heating the ink and ensuring the temperature of the ink is maintained at a predetermined temperature, above the ambient level.

2. Device according to claim 1, wherein at least five static mixers are incorporated at strategic points within the system.

3. Device according to claim 2, wherein the said stirring means for ink in the reservoir consist of a magnetic stirring arrangement or of a mechanical rotating stirrer.

4. Device according to claim 1, wherein said re-circulation loop is maintained at a flow rate several times faster than the flow of ink through the printing side of the system.

5. Inkjet printing device for inks containing a high loading of pigment, comprising an inkjet printhead for continuous printing, an ink reservoir, and a feeding line for feeding said printhead with ink from the reservoir and returning gutter ink from the printhead to the reservoir, wherein the device further comprises a two-stages mixing arrangement comprising a recirculation loop with mixing means, taking ink from the reservoir and returning it to the reservoir, and a stirring system for ink contained in the reservoir, and, additionally, a means of heating the ink and ensuring the temperature of the ink is maintained at a predetermined temperature, above the ambient level, wherein at least five static mixers are incorporated at strategic points within the device, and wherein the printhead feeding line comprises a filter placed between two static mixers, upstream of the printhead, and filter heating means arranged in such a manner that the ink temperature in the filter is higher than elsewhere in the printhead supply line.

6. Inkjet printing device for inks containing a high loading of pigment, comprising an inkjet printhead for continuous printing, an ink reservoir, and a feeding line for feeding said printhead with ink from the reservoir and returning gutter ink from the printhead to the reservoir, wherein the device further comprises a two-stages mixing arrangement comprising a recirculation loop with mixing means, taking ink from the reservoir and returning it to the reservoir, and a stirring system for ink contained in the reservoir, and, additionally, a means of heating the ink and ensuring the temperature of the ink is maintained at a predetermined temperature, above the ambient level, wherein at least five static mixers are incorporated at strategic points within the device, and wherein the recirculation loop comprises a recirculation pump located between two static mixers.

7. Device according to claim 6, wherein the recirculation pump is a peristaltic pump.

8. Device according to claim 6, wherein the recirculation pump is associated with inlet and outlet tube segments sunk in a heated block for maintaining the said main ink temperature level of the device.

9. Inkjet printing process for inks having a high loading of pigment, wherein an ink which exhibits the phenomenon of "soft settling" is prepared, and this ink is used for filling the ink reservoir of a printing device according to any one of the claims 1 to 3.

10. Process according to claim 9, wherein said pigment has a high density.

* * * * *

UNITED STATES PATENT AND TRADEMARK OFFICE

CERTIFICATE OF CORRECTION

PATENT NO. : 6,817,705 B1 
DATED : November 16, 2004
INVENTOR(S) : Dennis Crockett, Alan L. Hudd and Christopher M. Evans It is certified that error appears in the above-identified patent and that said Letters Patent is hereby corrected as shown below:

Column 4,
Line 41, please delete “lest” and insert in lieu thereof -- left --.

Signed and Sealed this

Fifth Day of April, 2005

JON W. DUDAS
*Director of the United States Patent and Trademark Office*